United States Patent [19]

Antunez, Jr. et al.

[11] Patent Number: 4,750,221

[45] Date of Patent: Jun. 14, 1988

[54] LINKAGE TILTABLE AROUND A PLURALITY OF AXES BY A SINGLE PUSH ROD

[76] Inventors: Armand E. Antunez, Jr., 20123 E. Sierra Madre, Glendora, Calif. 91740; Robert E. Wiegner, 17949 Contador, Rowland Heights, Calif. 91748

[21] Appl. No.: 81,414

[22] Filed: Aug. 4, 1987

[51] Int. Cl.[4] ..... E03D 5/00

[52] U.S. Cl. ..... 4/410

[58] Field of Search ..... 4/405, 406, 407, 408, 4/409, 410, 411, 412, 413, 414; 251/229, 231, 251, 279, 319; 74/99, 105, 107, 503

[56] References Cited

U.S. PATENT DOCUMENTS

| | | | |
|---|---|---|---|
| 1,555,620 | 9/1925 | Ayers et al. | 4/413 |
| 1,568,611 | 1/1926 | Morgan | 4/410 |
| 1,616,560 | 2/1927 | Vanderlip | 4/410 |
| 2,170,516 | 8/1939 | Duncan | 4/410 |
| 3,234,566 | 2/1966 | Rupp | 4/410 |
| 3,968,525 | 7/1976 | Alexander | 4/410 |
| 4,185,339 | 1/1980 | Morales | 4/414 |

FOREIGN PATENT DOCUMENTS

| | | | |
|---|---|---|---|
| 0587116 | 1/1959 | Italy | 4/410 |
| 0006554 | of 1911 | United Kingdom | 4/410 |
| 0307983 | 3/1929 | United Kingdom | 4/410 |

*Primary Examiner*—Henry K. Artis
*Assistant Examiner*—L. J. Peters
*Attorney, Agent, or Firm*—Donald D. Mon

[57] ABSTRACT

A push button linkage in which a lever is tiltably actuable around a plurality of selectible axes as the consequence of an axial push on a single push rod. It finds its principal application as an actuator for a flush valve in a tank type commode or urinal installation.

4 Claims, 2 Drawing Sheets

2
2
10
11
15
16
17
17a
18
19
20
21
22
23
24
25
26
27
28
29
30
31
35
36
37
38
39
40
41
42
45
47

LINKAGE TILTABLE AROUND A PLURALITY OF AXES BY A SINGLE PUSH ROD

FIELD OF THE INVENTION

This invention relates to tiltable linkages, for example linkages to open the flush valve in a water tank supplying a commode or a urinal.

BACKGROUND OF THE INVENTION

A water tank for flushing a commode is customarily controlled by two valves. One is a water level responsive valve often called a ballcock valve or a tank valve, which whenever the water level is below a pre-selected height, remains open until the water level returns to the selected height. Then this valve closes. Classically a float follows the water level and is effective to cause the tank valve to keep the tank full until the water is released. When the contents are released into the commode, the valve opens to refill the tank.

The other valve is commonly called a flush valve. The tank itself has a water outlet with a valve seat, near or in its bottom where the flush valve is fitted. The flush valve is held closed by the pressure of water when the tank is full or filling. When it is lifted off of the seat, it remains open, usually as the consequence of its own buoyancy, until the water level lowers as the consequence of discharging all or most of the water. It then loses its buoyancy and closes on the seat. Then it keeps the outlet closed while the tank is being refilled, and also until it is again lifted off of the seat.

The flush valve is customarily lifted off of the seat by a lever type linkage. An arm inside the tank is tiltably mounted to a shaft which passes through and is journaled in the tank wall. A handle is mounted to the shaft outside the wall. It is turned to tilt the lever. A flexible chain is connected between the lever and the flush valve so that turning the handle tilts the lever upwardly to lift the chain and thereby raise the valve to start a flushing cycle.

The above describes a conventional, widely-used commode flushing system. Its valves have been the subject of literally hundreds of iterations, all of which at one time were thought to be improvements, at least by their inventors. Strangely, relatively little attention has been paid to the linkages that control the tank valve. The above-described pivoted linkage is very popular, especially in homes where the appearance of the lever is aesthetically acceptable, and in places where vandalism is not anticipated.

However, in public installations, vandalism is to be expected wherever there is something on which the vandal can get a grip. A handle seems to be an enticement to such people. Accordingly, flush systems in public installations are frequently fitted with push buttons that do not project from their surrounding surfaces far enough readily to be grabbed and destroyed, and are circular so they cannot readily be twisted. The problem here is that push button actuators have not previously been suitable for tank type installations. Instead, they have generally been associated with pressure-balanced flush valves which control the flow of water directly from the water supply line to the using commode bowl or urinal. These valves tend to be much more expensive. They do eliminate the tank, but when a tank is acceptable, they are unsuitable even though they enable a push button to be used instead of a handle. A potential disadvantage to any lever type linkage is that there are numerous relative orientations of the handle relative to the tank wall and to the flush valve, and a specific actuating linkage is needed for each. This is a manufacturing and warehousing disadvantage. This is no problem for the push button valve that directly controls the flow of water in the pipe, but that is not a tank type installation. The problem is as serious for push-button linkage as for rotating linkages, and as a consequence, the advantages of a push-button actuation for a tank valve have not been significantly utilized.

It is an object of this invention to provide a tiltable linkage that is able to be rotated around a plurality of axes by actuation of a single push rod. Then a single device can be used for a wide range of tank applications.

BRIEF DESCRIPTION OF THE INVENTION

A linkage according to this invention includes a base mounted to the wall of a water tank, generally in a hole through that wall. A lever is adapted to be attached to a lift device such as a chain or cable connected to the flush valve. It is pivotally mounted to the base. It is a feature of this invention that the base is provided with a plurality of pivots, whose axes of rotation extend in different directions. The lever is selectably mounted to either one of them. A push rod is slidably mounted in the base and projects therefrom. It carries a cam surface. The lever carries cam surfaces one of which is engageable with the cam surface on the push rod, whichever pivot the lever is mounted to. Then a push on the rod will lift the lever in whatever plane of rotation it is in.

According to a preferred but optional feature of the invention, the lever is mounted to the pivot by a key slot and cross-bar combination.

The above and other features of this invention will be fully understood from the following detailed description and the accompanying drawings, in which:

DETAILED DESCRIPTION OF THE INVENTION

Figures 1, 2:
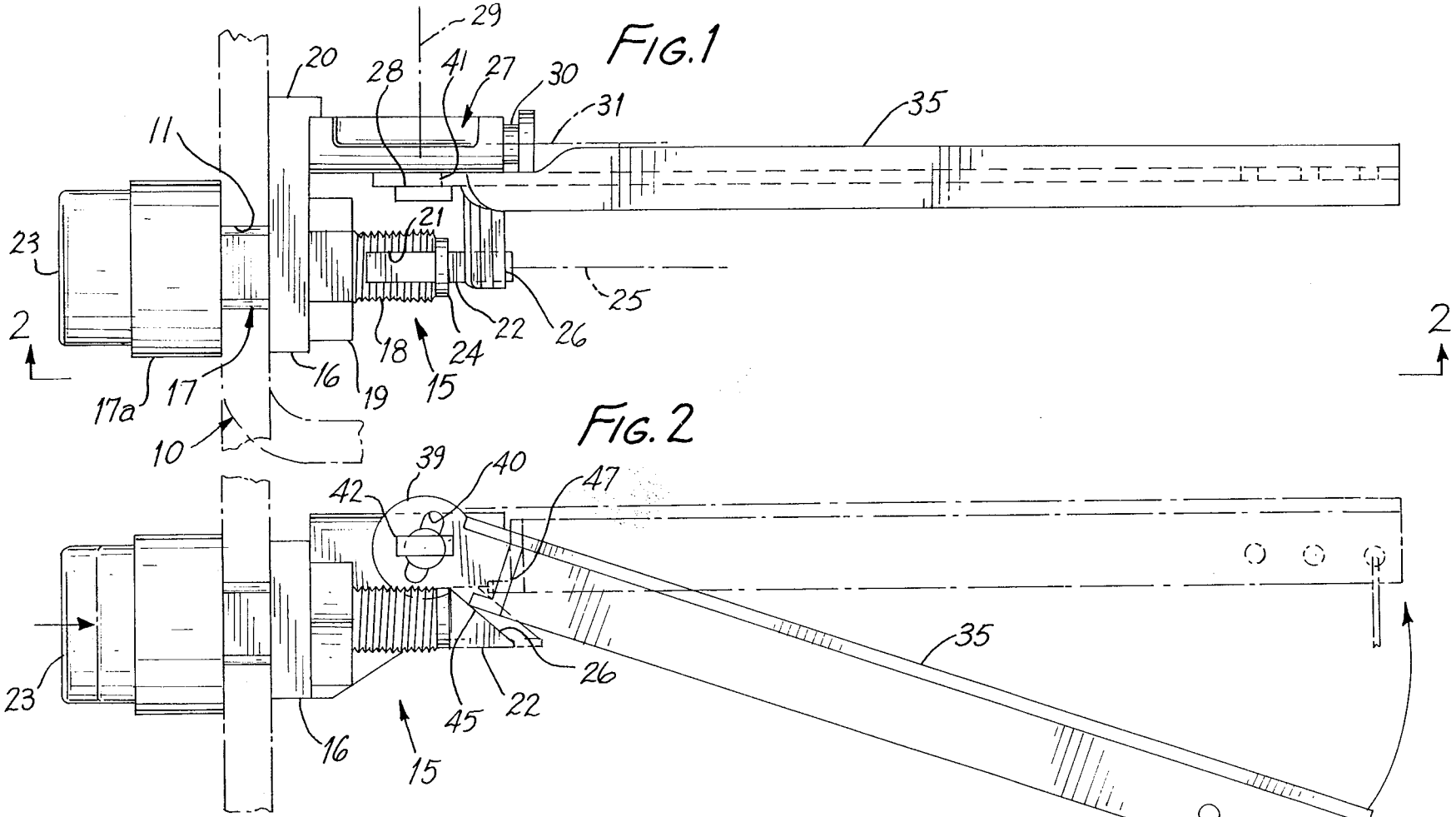
FIG. 1 is a top view showing the linkage of the invention.
FIG. 2 is a side view of FIG. 1, showing the linkage in two positions.

In FIG. 1 the wall 10 of a water tank is shown with a hole 11 therethrough. The presently- preferred form of linkage 15 according to the invention is shown mounted in this hole.

Linkage 15 includes a base 16, a stem 17 passing through the hole, a head 17 on the stem, an external thread 18, and a nut 19. A lateral extension 20 of the base fits against the inside of the wall and the linkage is firmly held in place by tightening the nut.

A passage 21 through the stem slidably holds a push rod 22. A push button 23 terminates the push rod outside of the tank. The stem is slotted at the other end so as to hold the push rod without rotation. A stop shoulder 24 limits the outward movement of the push rod in the stem. The push rod has an axis 25 of slidable movement.

A sloping cam surface 26 is formed on the stem, preferably at or adjacent to its free end.

A pivot block 27 is formed as part of the base. It may be cast integrally, or be made separately and joined to the remainder of the base as preferred. A first pivot 28 has an axis of rotation 29. A second pivot 30 has an axis of rotation 31. Axes 20 and 31 are not parallel to one another. Conveniently, as viewed in the top view, they are perpendicular to one another, although they need not intersect. Similarly, in top view, axes 25 and 31 are parallel to one another and axes 25 and 29 are perpendicular to one another.

Depending on the number of installations intended to be accommodated by a single device, more than two pivots can be provided, and their elevations and angles of axes may be varied. The illustrations enable the device to be used either in the side wall or in the front wall of a tank.

A lever 35 has a free end 36 with holes 37 to receive a chain 38 or cable that extends downwardly to the flush valve. At its pivot end 39, the lever is flat and has a lateral slot 40. The pivot has a central pin 41 and a cross-bar 42. The cross-bar can pass through the slot when they are aligned. In other positions it retains the lever. This is sometimes called a "key-slot" type pivot. It enables the lever readily to be attached to the base or to be detached from it, so it can selectively be mounted to either one of the pviots.

Figure 3:
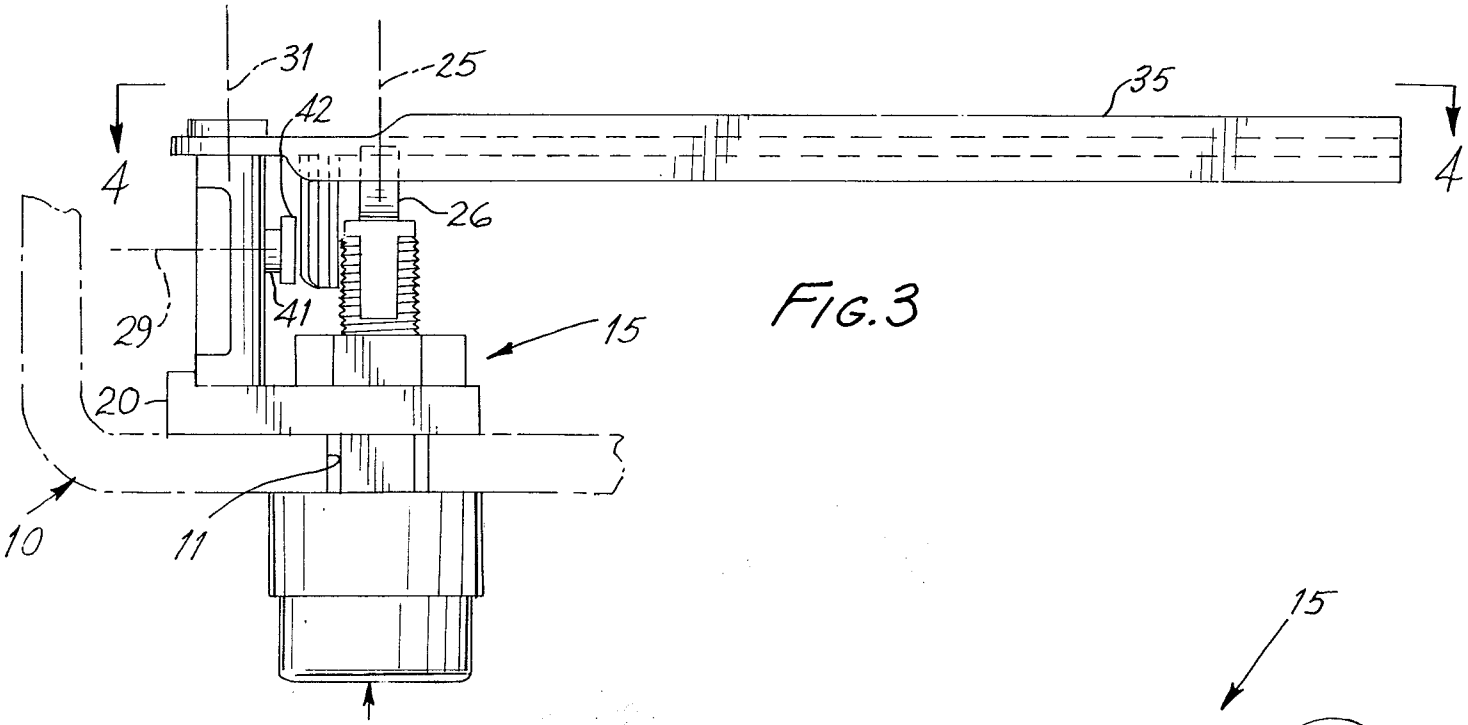
FIG. 3 is a top view of the invention, with the lever mounted to a different pivot.

In FIG. 1, the lever is mounted to pivot 28. In FIG. 3 it is mounted to pivot 30. The position of FIG. 1 will generally be mounted in a side wall. In FIG. 3 it will generally be a front wall installation. Notice that in both situations,a the lever will rotate in a plane parallel to the front wall, although this is not a limitation on the invention.

Figure 4:
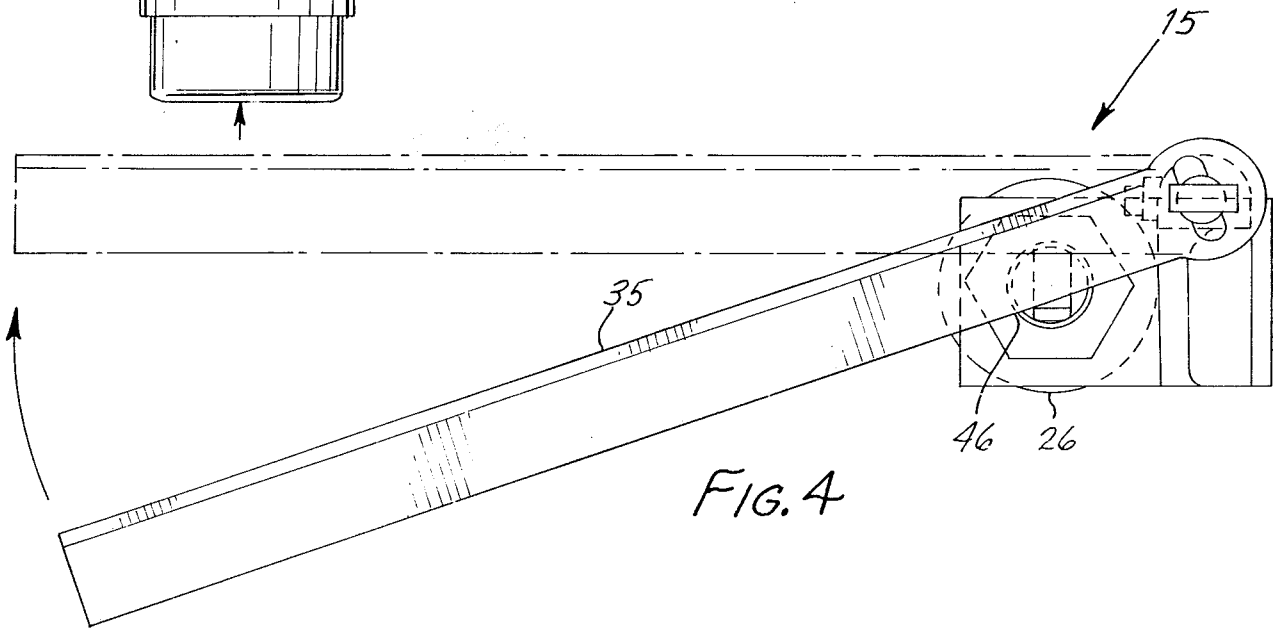
FIG. 4 is a side view of FIG. 3, showing the linkage in two positions.

The lever carries a pair of cam surfaces 45,46. Surface 45 is carried on an extension 47 on the lever, and contacts cam surface 26 only when mounted to pivot 28. This is the FIG. 1 condition. Surface 46 is carried on the lever body itself, and contacts cam surface 26 only when the lever is mounted to pivot 30. In both situations, pushing on the rod will cause the cam surfaces to react and lift the lever. The weight of the lever will cause the reaction to restore the push-button to its outer position. The lifted portion is shown in dashed line in FIGS. 2 and 4, and the repose condition in solid line.

Other types of pivots can be provided instead. For example, headed pins passed through the lever and threaded into the body. The illustrated pivot is reliable, convenient, inexpensive, and readily molded. It is preferred, but is not a limitation on the invention.

The type of tank valve is of no consequence to the invention, except that it must be actuated as the consequence of an upward pull exerted by the lever. A useful example is shown in Antunez U.S. Pat. No. 3,154,794 which is made a part hereof by reference in its entirely for its showing of a tank valve, its operation and its installation.

This invention thereby provides a single linkage applicable to multiple types of installations, where the lever must tilt around different axes relative to the axis of a push rod. It provides the advantages of push button actuation along with the advantages of multiple applications, using only one base and push rod.

This invention is not to be limited by the embodiment shown in the drawings and described in the description, which is given by way of example and not of limitations, but only in accordance with the scope of the appended claims.

I claim:

1. A push button linkage comprising:

a base mountable in a tank wall that has a front and side wall;

a push rod passing though said base, a push button on one end, and a cam surface spaced therefrom, said push rod having an axis of slidable movement, and said cam surface sloping relative to this axis;

a plurality of pivots on said base, each pivot having a respective axis of rotation, said axes of rotation being non-parallel to one another;

wherein the axes are orthogonal, for the purpose of being able to mount the push button linkage on either the front or side wall of said tank a lever having a dimension of length, means joining it to any selected one of said pivots, and a pair of cam surfaces, each cam surface being so disposed and arranged to contact and react with the cam surface on the push rod when the lever is mounted to one of said pivots the other respective pivot being unused, whereby sliding movement of the push rod will tilt the lever when the lever is mounted to either of the pivots.

2. A linkage according to claim 1 in which the said pivots are key-hole types, said pivots including a pin and a cross-bar, and the means on said lever being a slot, said cross-bar being passable through said slot in one relative alignment of the lever, and being barred against passage in other.

3. A linkage according to claim 1 in which one of said cam surfaces on the lever constitutes a surface along its length, and the other is formed on a lateral extension of the lever.

4. In combination:

a linkage according to claim 1; and a tank wall with a hole therethrough, said base passing through said hole, means to hold said base to the wall, said push button being exposed at the end of the push rod outside of the tank.

* * * * *